US011134823B2

(12) United States Patent
Luedke et al.

(10) Patent No.: US 11,134,823 B2
(45) Date of Patent: Oct. 5, 2021

(54) MOP BUCKETS AND ASSOCIATED METHODS

(71) Applicant: Rubbermaid Commercial Products LLC, Atlanta, GA (US)

(72) Inventors: Adam Luedke, Kalamazoo, MI (US); Russell Arthur Banks, Huntersville, NC (US)

(73) Assignee: RUBBERMAID COMMERCIAL PRODUCTS LLC, Atlanta, GA (US)

( * ) Notice: Subject to any disclaimer, the term of this patent is extended or adjusted under 35 U.S.C. 154(b) by 52 days.

(21) Appl. No.: 15/619,040

(22) Filed: Jun. 9, 2017

(65) Prior Publication Data

US 2018/0353049 A1 Dec. 13, 2018

(51) Int. Cl.
*A47L 13/59* (2006.01)

(52) U.S. Cl.
CPC ..... *A47L 13/59* (2013.01)

(58) Field of Classification Search
CPC ..... A47L 13/58; A47L 13/59; A47L 13/20; A47L 13/51; A47L 13/60; A47J 47/18
See application file for complete search history.

(56) References Cited

U.S. PATENT DOCUMENTS

| | | | |
|---|---|---|---|
| D28,095 | S | 12/1897 | Mills |
| D28,326 | S | 3/1898 | Joy |
| 664,185 | A | 12/1900 | Stran |
| D107,096 | S | 11/1937 | Rideout |
| 2,144,945 | A | 1/1939 | Sutton |
| 2,149,255 | A | 3/1939 | Fader |
| 2,255,091 | A | 9/1941 | Vaughn |
| 2,321,981 | A | 6/1943 | Bowers |
| 2,392,208 | A | 1/1946 | Wilken |
| 2,671,239 | A | 3/1954 | Wisner |
| 2,860,809 | A | 11/1958 | Perry |
| 3,009,603 | A | 11/1961 | Stockdale |
| 3,027,041 | A | 3/1962 | Stansbury, Jr. et al. |

(Continued)

FOREIGN PATENT DOCUMENTS

| | | | |
|---|---|---|---|
| EP | 0781524 | A2 | 7/1997 |
| WO | 95/27433 | A1 | 10/1995 |

OTHER PUBLICATIONS

Kim et al. "Complaint Joint Actuator with Dual Spiral Springs." 2013. IEEE/ASME Transactions of Mechatronics. <http://dyros.snu.ac.kr/wp-content/uploads/2013/05/TMECH2260554.pdf>. (Year: 2013).*

*Primary Examiner* — Joel D Crandall
(74) *Attorney, Agent, or Firm* — Eversheds Sutherland (US) LLP

(57) ABSTRACT

Mop buckets and methods of using the same are provided. A mop bucket includes a liquid-retaining portion that permits retained liquid to move in a liquid-movement direction extending from the first sidewall portion toward the second sidewall portion within a higher-momentum region and an energy-dissipation device disposed within the liquid-retaining portion and extending into the higher-momentum region, the energy-dissipation device being configured to inhibit buildup of momentum of liquid in the higher-momentum region along at least a portion of the liquid-movement direction by breaking surface tension of the liquid. The energy-dissipation device includes at least three baffles.

18 Claims, 14 Drawing Sheets

(56) References Cited

U.S. PATENT DOCUMENTS 3,341,876 A 9/1967 Campbell
3,844,441 A 10/1974 Clark
3,935,962 A 2/1976 Schubert et al.
3,995,434 A 12/1976 Kato
4,135,530 A 1/1979 Cheney
4,249,666 A 2/1981 Hubert et al.
D270,961 S 10/1983 Hawkins et al.
4,707,877 A * 11/1987 Griffin ..... A47L 13/59 100/233
4,827,562 A 5/1989 Blase et al.
D305,467 S 1/1990 Dagge
D305,948 S 2/1990 Rentz
5,086,917 A 2/1992 Dziersk et al.
D350,632 S 9/1994 Cummins
5,346,371 A 9/1994 Bialy et al.
D353,241 S 12/1994 Breen
5,397,036 A 3/1995 Maiwald
2,013,577 A 9/1995 Pardee
D374,321 S 10/1996 Mandell et al.
5,641,087 A 6/1997 Moffitt
D395,531 S 6/1998 Mandall et al.
5,774,929 A * 7/1998 Jurgens ..... A47L 13/60 100/121
D407,878 S 4/1999 Carlson
D408,602 S 4/1999 Carlson
5,971,199 A 10/1999 Jackson et al.
D417,051 S 11/1999 Dickinson et al.
D426,361 S 6/2000 Young
D429,396 S 8/2000 Houry et al.
D429,862 S 8/2000 Houry et al.
6,115,877 A 9/2000 Morad
6,220,287 B1 4/2001 Wolf
6,560,815 B1 5/2003 Brennan et al.
D489,852 S 5/2004 Perelli
D495,448 S 8/2004 Moforis
7,571,831 B2 8/2009 Hicks et al.
8,544,141 B1 * 10/2013 Kyde ..... A47J 47/18 15/257.7
8,615,842 B2 12/2013 Treacy
2002/0120997 A1 9/2002 Alt
2003/0217428 A1 11/2003 Perelli
2005/0252921 A1 11/2005 Van Landingham, Jr.
2006/0070202 A1 * 4/2006 Lauer ..... A47J 47/18 15/264
2007/0266518 A1 * 11/2007 Hoyle ..... A47L 13/59 15/261
2014/0075704 A1 * 3/2014 Michelson ..... A47L 13/144 15/244.4

* cited by examiner

MOP BUCKETS AND ASSOCIATED METHODS

BACKGROUND

Mop bucket systems are commonly used for cleaning purposes, to facilitate the mopping of floors. A mop bucket contains liquid used for cleaning.

With a conventional mop bucket, cleaning liquid may spill or splash during use. For example, often the mop bucket and cleaning liquid must be moved from one location to another. During this movement, the mop bucket will be subjected to differing Newtonian forces. The mop bucket will experience a starting force as it is initially accelerated toward the next location and will experience a stopping force when it reaches that location and is decelerated. Also, while the bucket is being moved, it may experience instantaneous turbulent forces at the interface between the liquid and air, sometimes called wave amplification or ripples. The changing forces on the mop bucket will cause the cleaning liquid to be displaced relative to the mop bucket. The displacement of the cleaning liquid can result in the formation of a wave that splashes over the top of a wall of the mop bucket and out onto a floor or stairway. Also, the amplification of these waves due to the high degree of turbulence may also cause splashing and liquid droplets to exit the mop bucket.

Spillage of the cleaning liquid is problematic. For example, cleaning liquid that has spilled out of the mop bucket onto a floor or stairway can create a slip-and-fall hazard if not immediately removed. Even if the liquid is immediately removed, non-productive man hours may be required to clean the spill. Spillage also is inefficient and undesirable because it can result in the loss of cleaning liquid.

SUMMARY

In one aspect, a mop bucket system is provided, including a liquid-retaining portion configured to retain liquid and having a lower or bottom wall portion, a first sidewall portion, a second sidewall portion facing the first sidewall portion, a third sidewall portion, and a fourth sidewall portion facing the third sidewall portion, wherein the liquid-retaining portion permits retained liquid to move in a liquid-movement direction extending from the first sidewall portion toward the second sidewall portion within a higher-momentum region. The mop bucket system further includes an energy-dissipation device disposed within the liquid-retaining portion and extending into the higher-momentum region, the energy-dissipation device being configured to inhibit buildup of momentum of liquid in the higher-momentum region along at least a portion of the liquid-movement direction by breaking surface tension of the liquid. The energy-dissipation device includes: a first baffle and a second baffle each disposed between the first and second sidewall portions and within the higher-momentum region, wherein the first baffle projects from the third sidewall portion and the second baffle projects from the fourth sidewall portion, and wherein the first and second baffles each project such a distance from the respective third and fourth sidewall portions that the first and second baffles are discontinuous in that the first and second baffles do not in combination form a single, uniformly shaped baffle, and a third baffle disposed between the third and fourth sidewall portions and within the higher-momentum region, wherein the third baffle projects from the first sidewall portion.

In another aspect, a wringer for a mop bucket is provided, including means for attaching the wringer on a rim that defines an opening of a mop bucket, a first wringing plate, a second wringing plate, which is moveable toward the first wringing plate to wring liquid from a mop, a wringer arm configured to be actuated to cause movement of the second wringing plate toward the first wringing plate, such that the wringer is actuated between a mop-receiving position and a mop-wringing position, a linkage coupling the wringer arm to the second wringing plate, and a spiral torsion spring engaging the wringer arm or the linkage, such that the wringer is urged into the mop-receiving position, absent an actuating force being applied.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Mopping systems and associated components are provided in this disclosure. Certain embodiments of such systems and components can reduce the spillage of cleaning liquid from the bucket. Certain features of the mopping systems are described in U.S. Pat. No. 7,571,831, which is incorporated by reference.

Figure 10:
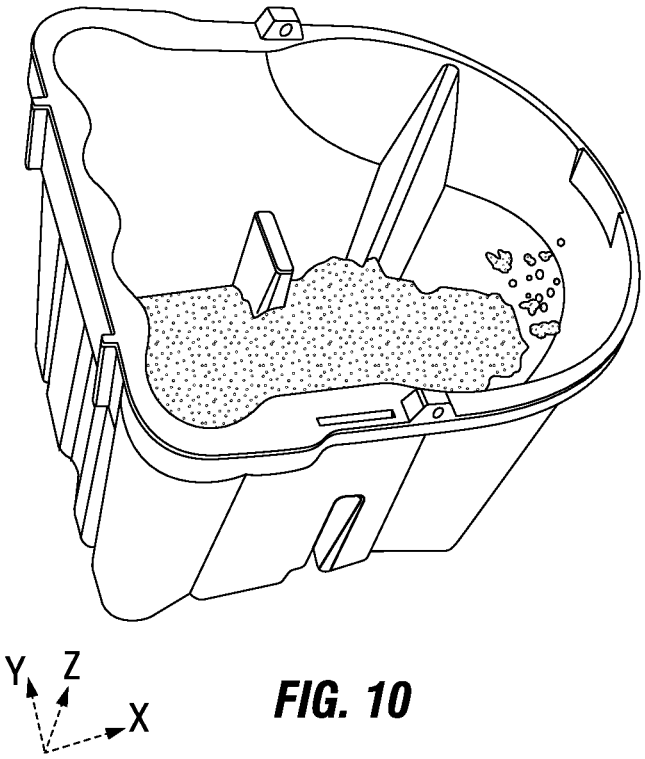
FIG. 10 is a perspective view of one of the prototypes used in the experimental splash testing described in the Example.
Figure 11:
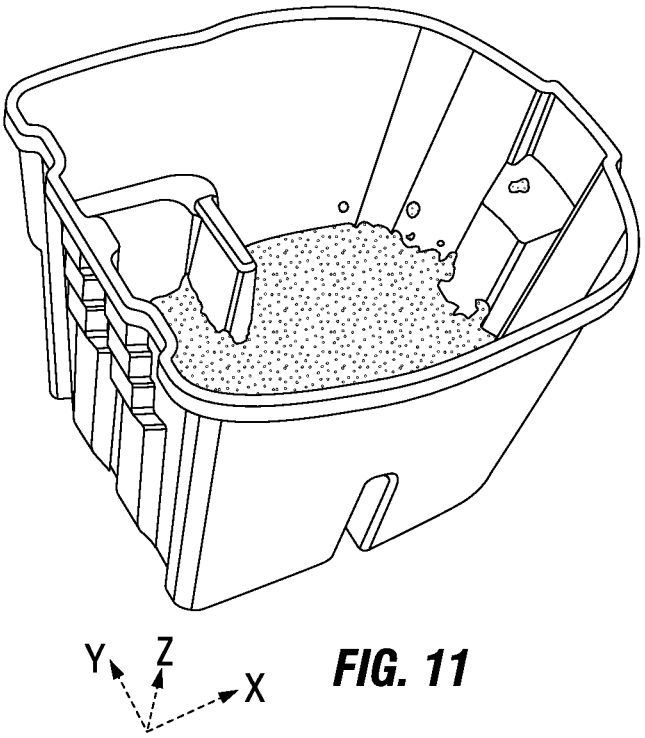
FIG. 11 is a perspective view of another of the prototypes used in the experimental splash testing described in the Example.
Figure 12:
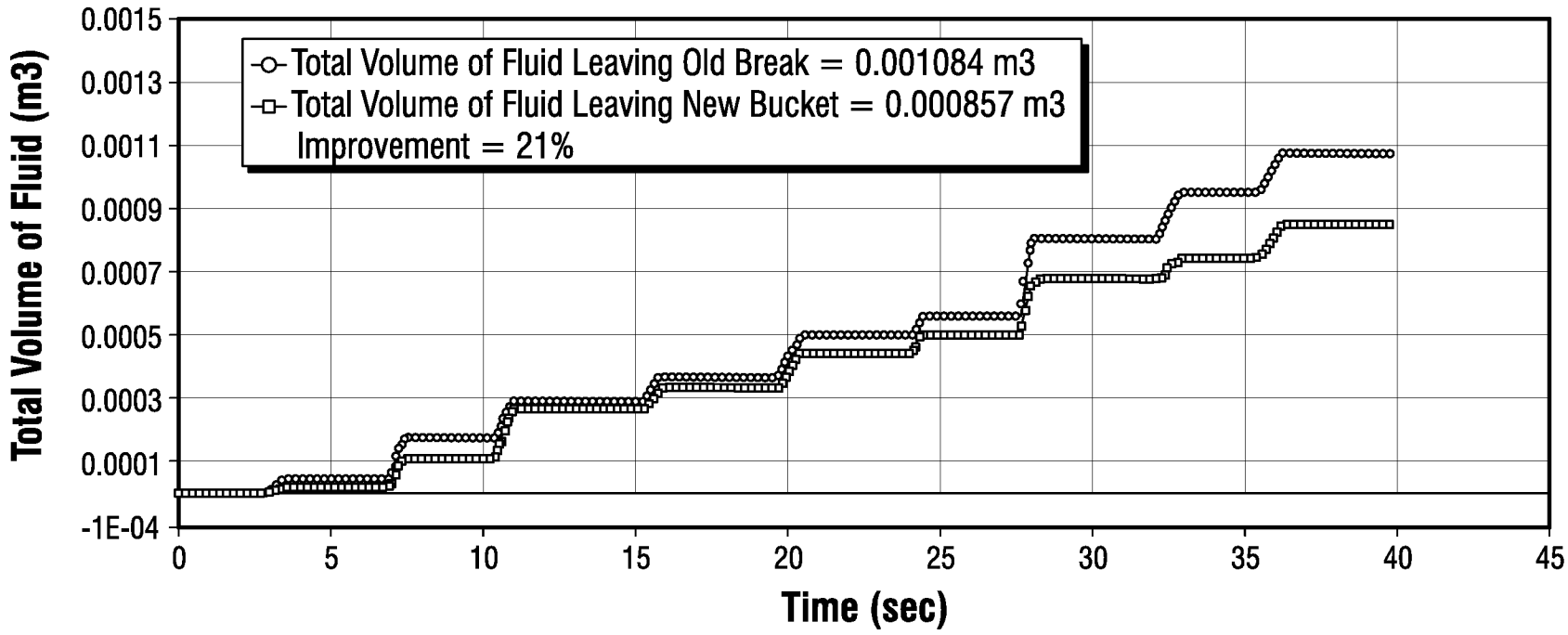
FIG. 12 is a graph showing the results of the experimental splash testing described in the Example.

Certain embodiments of mop bucket systems having an incorporated wringer, as described in this disclosure, are shown in FIGS. 1A-1B, 2A-2B, and 3, while certain embodiments of mop buckets, as described in this disclosure, are shown in FIGS. 5A-5G and 6, and certain embodiments of wringers for mop buckets, as described in this disclosure, are shown in FIGS. 4 and 7A-7G. Certain embodiments of linkage and spring assemblies for use in a mop wringer, as described in this disclosure, are shown in FIGS. 8A-8B and 9A-9B. The results of experimental splash testing, and the prototypes analyzed in the results, are shown in FIGS. 10, 11, and 12.

In certain embodiments, as shown in FIGS. 5A-5G, a mop bucket system (i.e., assembly) 10 includes a liquid-retaining portion 20 and an energy-dissipation device 50. As shown in FIGS. 1A-1B and 2A-2B, in certain embodiments, the mop bucket system 10 also includes a wringer 100 for receiving and squeezing the head of a mop, or the like, to remove liquid therefrom.

Figure 5A:
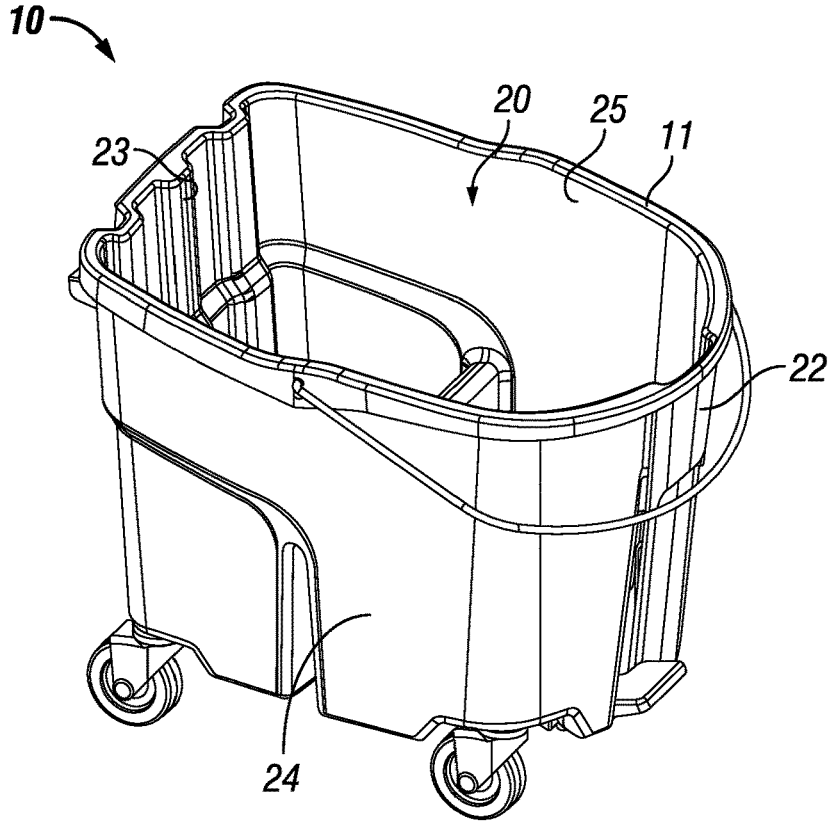
FIG. 5A is an upper perspective view from a first side of one embodiment of a mop bucket.
Figure 5B:
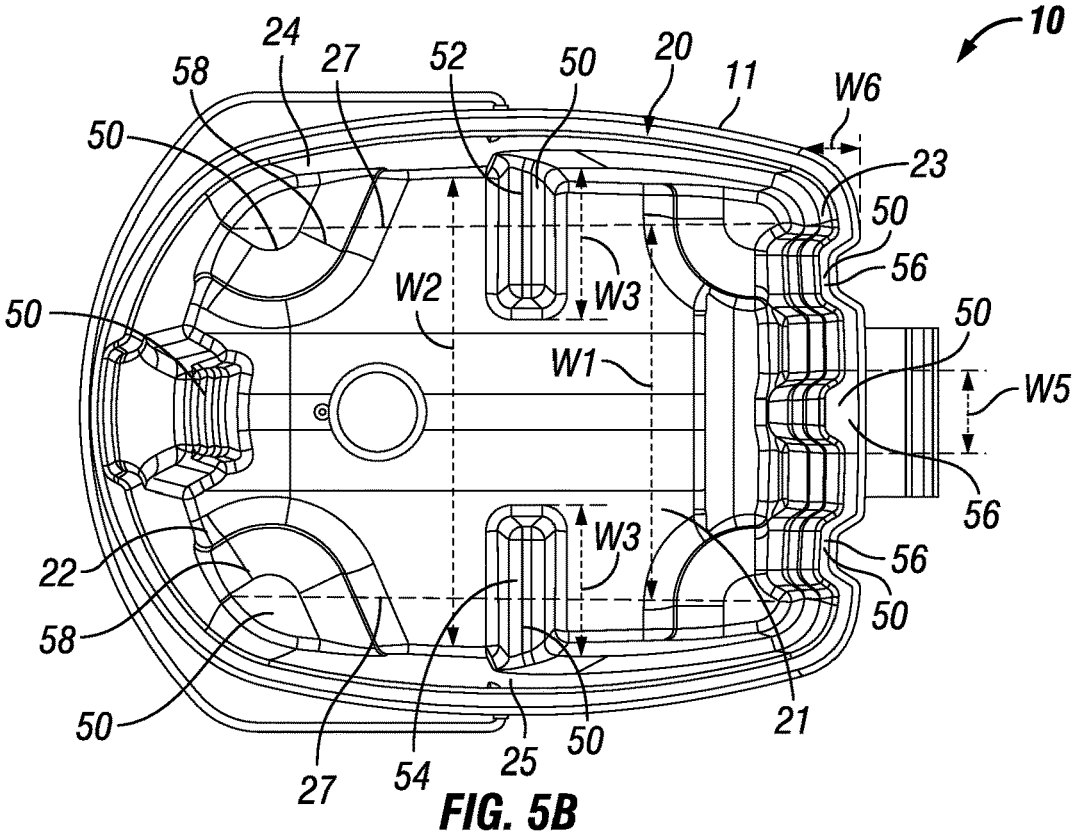
FIG. 5B is an upper plan view of the mop bucket of FIG. 5A.
Figure 5C:
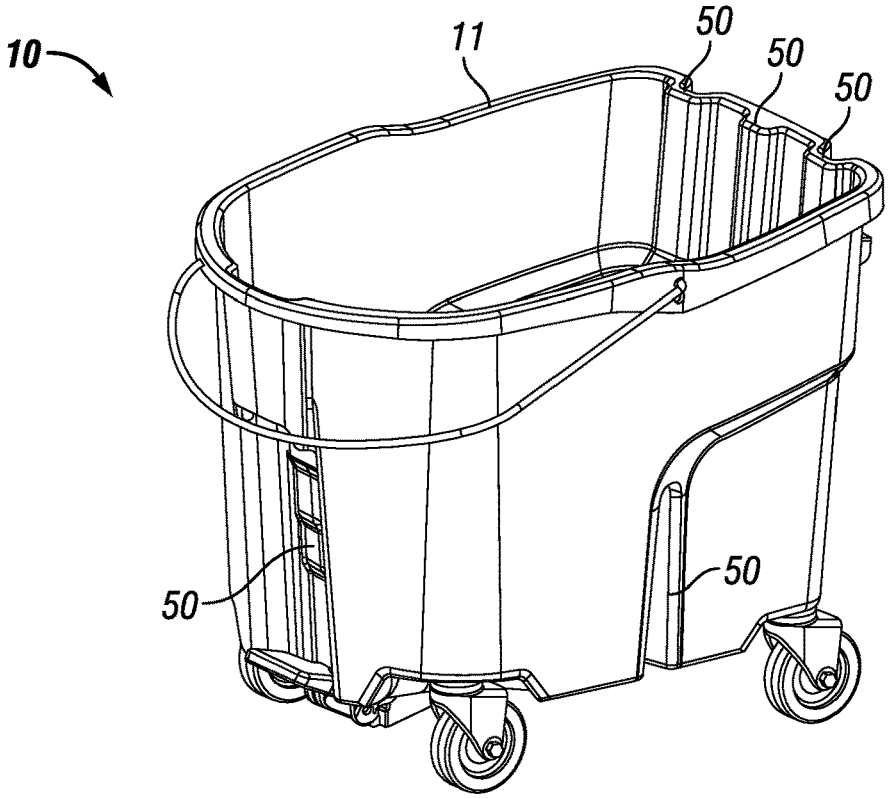
FIG. 5C is an upper perspective view from a second side of the mop bucket of FIG. 5A.
Figure 5D:
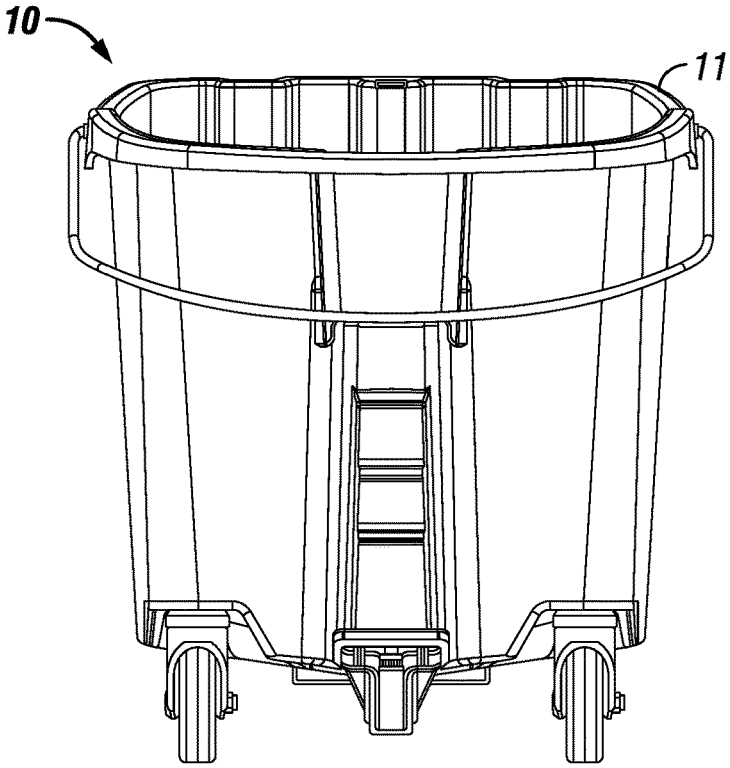
FIG. 5D is a front plan view of the mop bucket of FIG. 5A.

A mop bucket 11 can provide the liquid-retaining portion 20, which is configured to retain liquid, such as cleaning liquid used to mop floors. As shown in FIGS. 5A-5B, the liquid-retaining portion 20 includes a lower or bottom wall portion 21, a first sidewall portion 22, a second sidewall portion 23 facing the first sidewall portion 22, a third sidewall portion 24, and a fourth sidewall portion 25 facing the third sidewall portion 24. The sidewall portions 22, 23, 24, 25 can be connected in a variety of forms. For example, they can be portions of a rounded sidewall with no clear demarcations between the sidewall portions (see, for example, the connection between sidewall portions 22 and 24) or they can be connected by distinct corners or edges that provide clear demarcations between the sidewall portions (see, for example, the connection between sidewall portions 23 and 24).

Figure 5E:
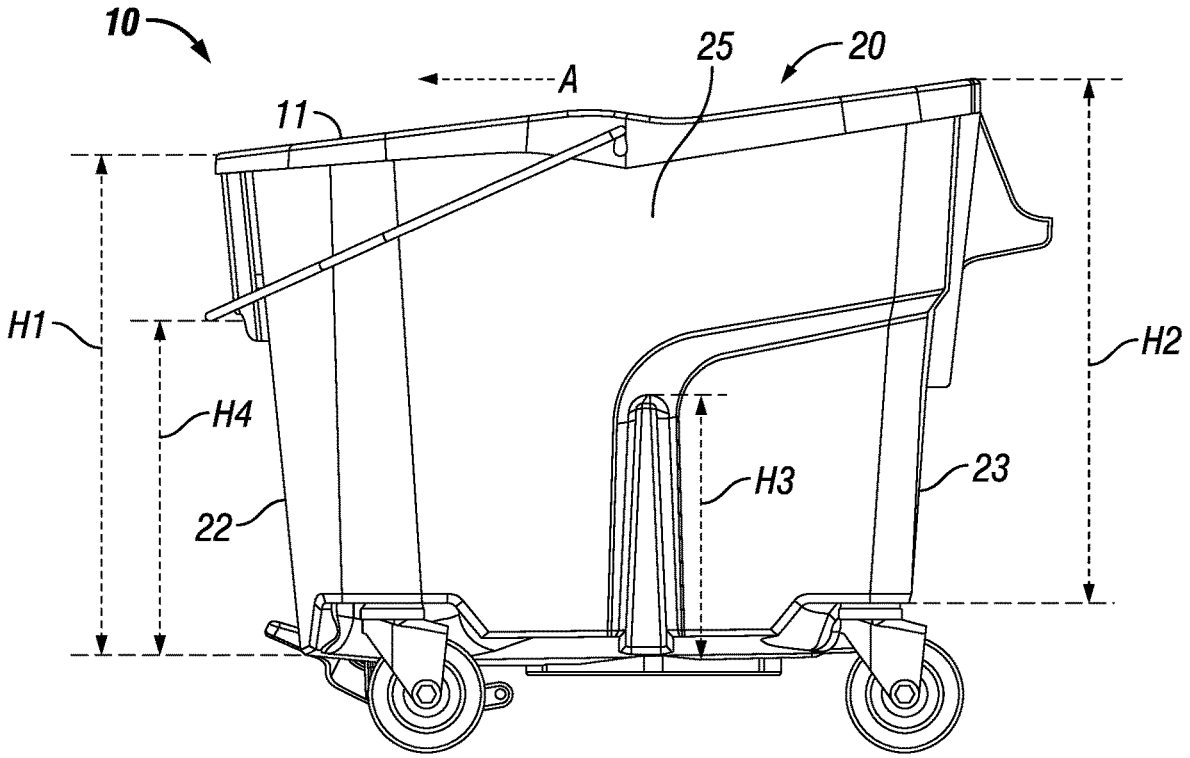
FIG. 5E is a side plan view of the mop bucket of FIG. 5A.
Figure 5F:
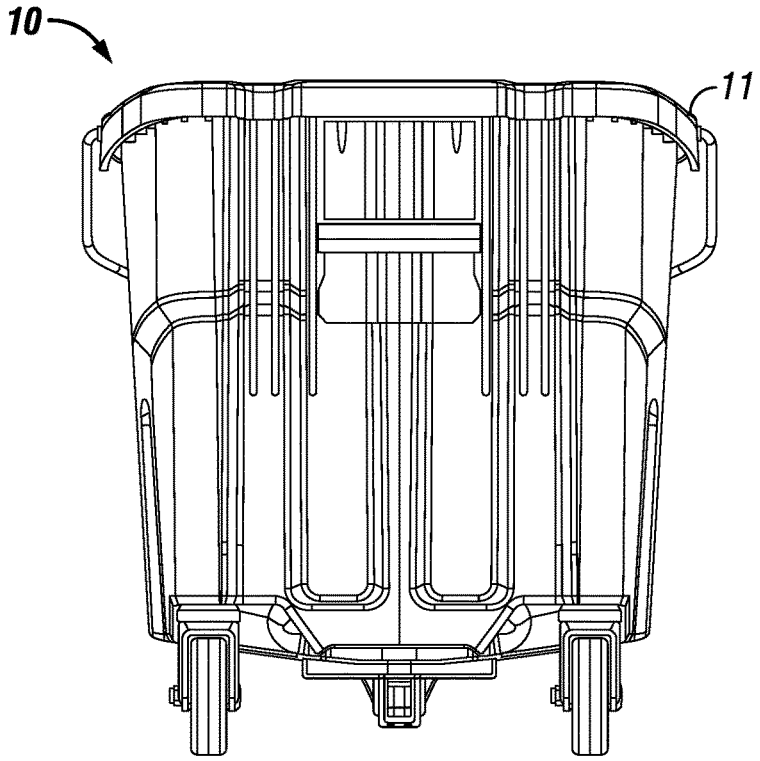
FIG. 5F is a rear plan view of the mop bucket of FIG. 5A.
Figure 5G:
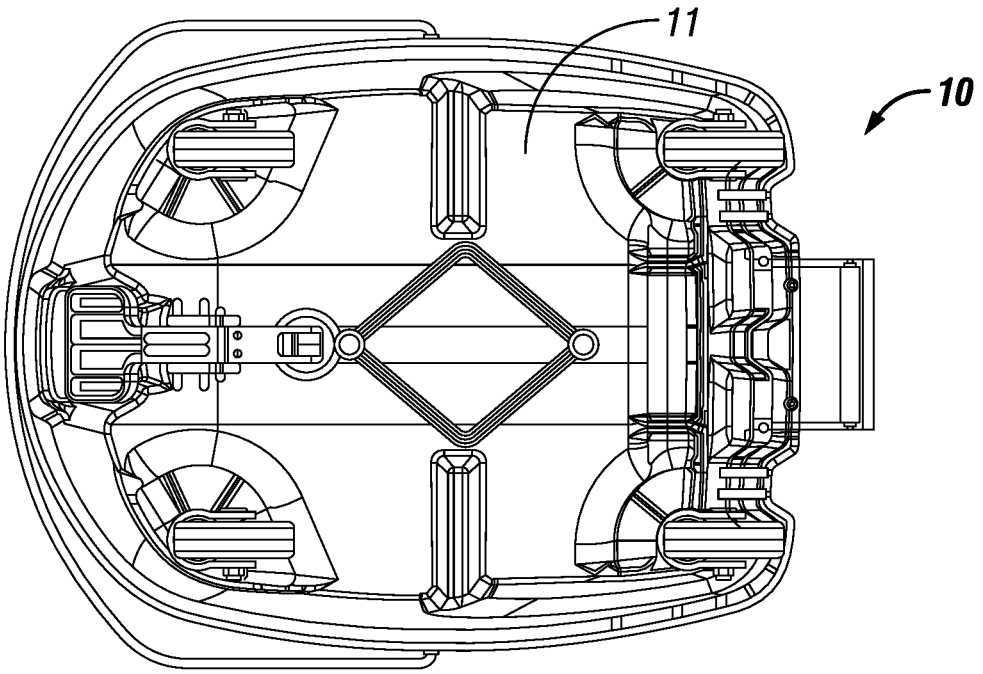
FIG. 5G is a bottom plan view of the mop bucket of FIG. 5A.

In certain embodiments, the sidewall portions 22, 23, 24, 25 have approximately the same height from the lower or bottom wall portion 21. In other embodiments, the first sidewall portion 22 is shorter than the second sidewall portion 23. As shown in FIG. 5E, in one exemplary embodiment, the first sidewall portion 22 has a height H1 of about 12 inches and the second sidewall portion 23 has a height H2 of about 15 inches. In such embodiments, the height of the third and fourth sidewall portions 24, 25 may taper between the heights of the first and second sidewall portions 22, 23.

When the mop bucket system 10 is subjected to differing forces, liquid can be displaced relative to the liquid-retaining portion 20. For example, if the mop bucket system 10 is moved in the direction of the arrow A shown in FIG. 5E, the liquid (not shown) may move in an opposite direction relative to the liquid-retaining portion 20, i.e., in a liquid-movement direction extending from the first sidewall portion 22 toward the second sidewall portion 23.

Within the liquid-retaining portion 20, the displacement of the liquid may not be evenly distributed. As the liquid-retaining portion 20 stops or starts, the energy of the liquid at the center is greater than along the third and fourth sidewall portions 24, 25, because of the no-slip boundary condition, i.e., forces along the third and fourth sidewall portions 24, 25 will slow the movement of the liquid near those sidewall portions. Consequently, a higher-momentum region can exist in the liquid. For the purpose of defining a location for elements of the energy-dissipation device 50, as explained further below, boundaries of the higher-momentum region have been established by showing dashed lines 27 in FIG. 5B, which have a width W1 between them. Thus, the location of the dashed lines 27 and the corresponding width W1 are not intended to necessarily require any specific attribute with regard to the energy or velocity of the liquid. In certain embodiments, the width W1 is about 70 percent of a distance W2 between the third and fourth sidewall portions 24, 25, though W1 could be redefined as, for example, approximately 65 percent, 50 percent, or 30 percent of the distance W2, depending on the particular design of the liquid-retaining portion. In the embodiment illustrated in FIG. 5B, the higher-momentum region has a center or central portion that coincides with the center or central portion of the liquid-retaining portion 20.

Figure 1B:
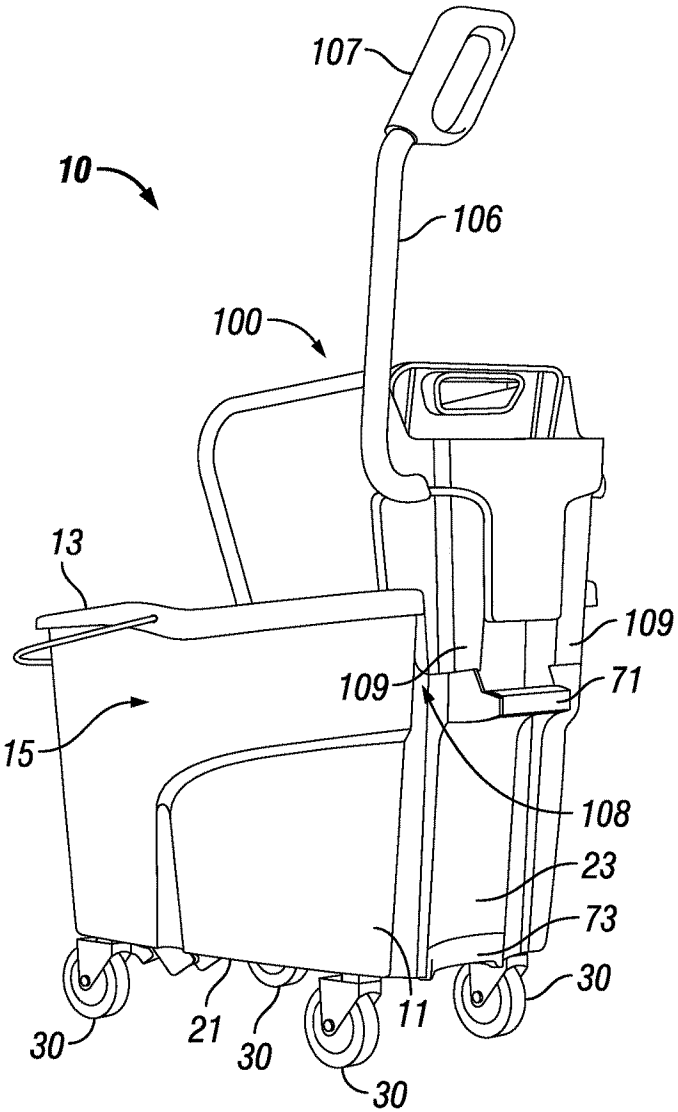
FIG. 1B is a rear perspective view of the mop bucket system of FIG. 1A.
Figure 1A:
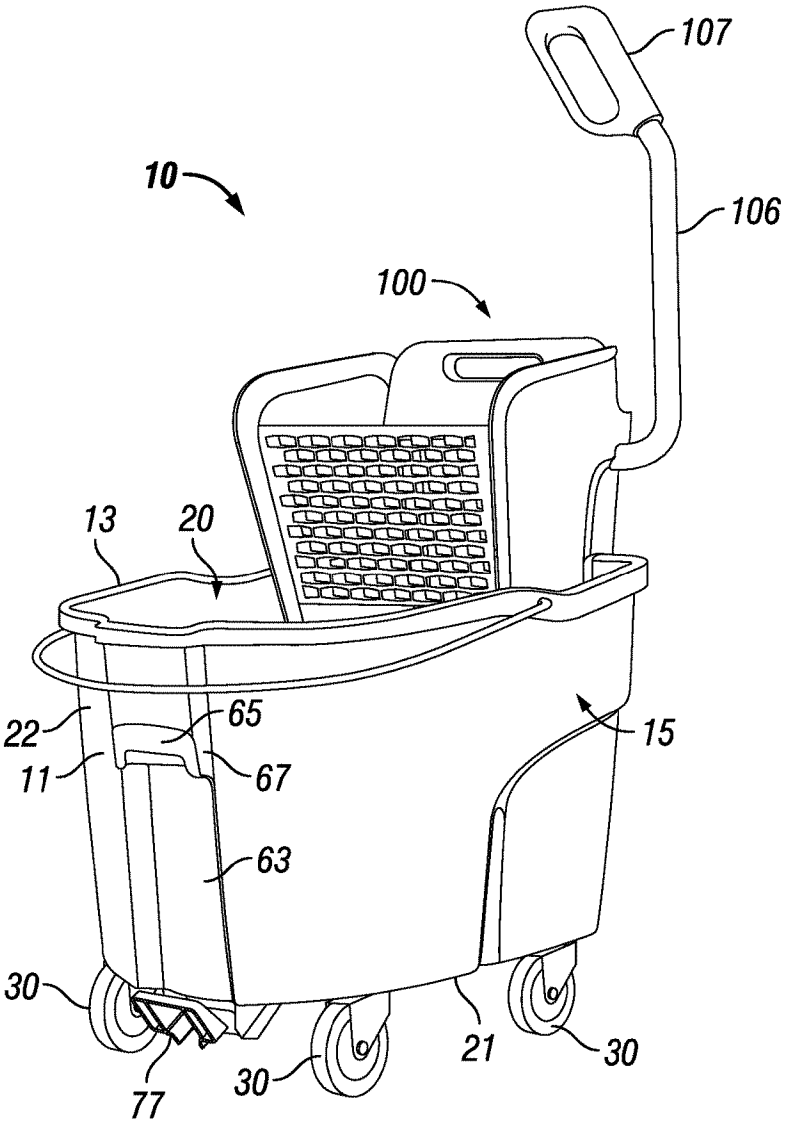
FIG. 1A is a forward perspective view of one embodiment of a mop bucket system.

As shown in FIGS. 1A-1B, the mop bucket system 10 may have rolling members 30, such as casters, to facilitate movement of the mop bucket system 10 with respect to a floor, surface, or ground. In some embodiments, the rolling members 30 are connected to a dolly (not shown), which receives the liquid-retaining portion 20. In other embodiments, the rolling members 30 are coupled to the lower or bottom portion of the liquid-retaining portion 20. As used herein, the terms "couple" and "coupled" are used broadly and refer to components being directly or indirectly connected to one another via any suitable fastening, connection, or attachment mechanism. In yet another embodiment, the rolling members are omitted and the mop bucket system 10 can be moved from location to location by carrying the mop bucket system 10.

Figure 6:
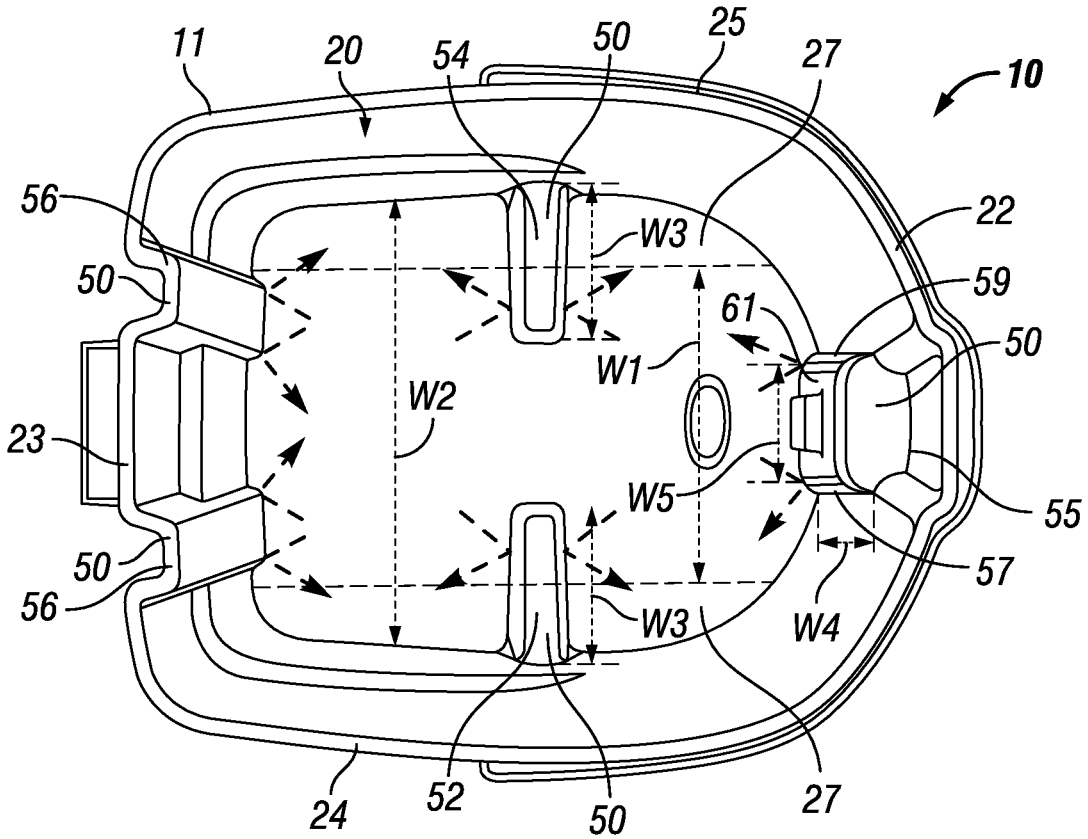
FIG. 6 is an upper view of one embodiment of a mop bucket.
Figure 7A:
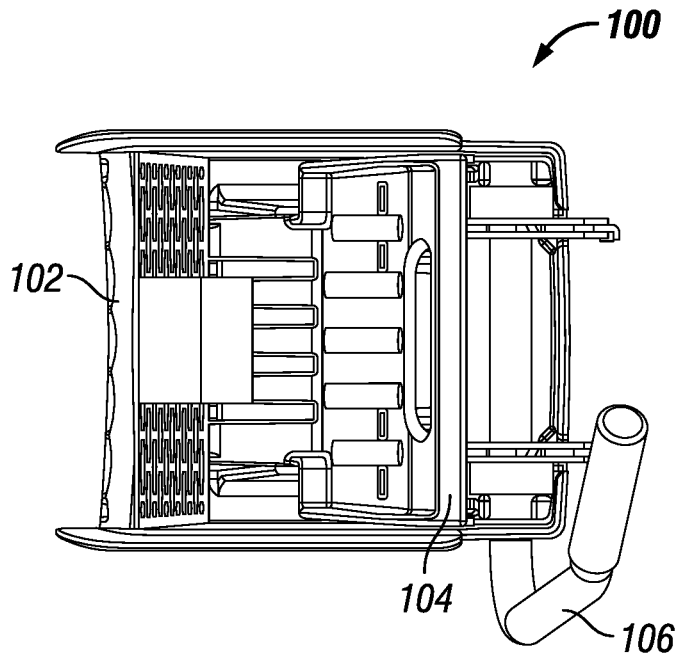
FIG. 7A is an upper view of one embodiment of a wringer.
Figure 7B:
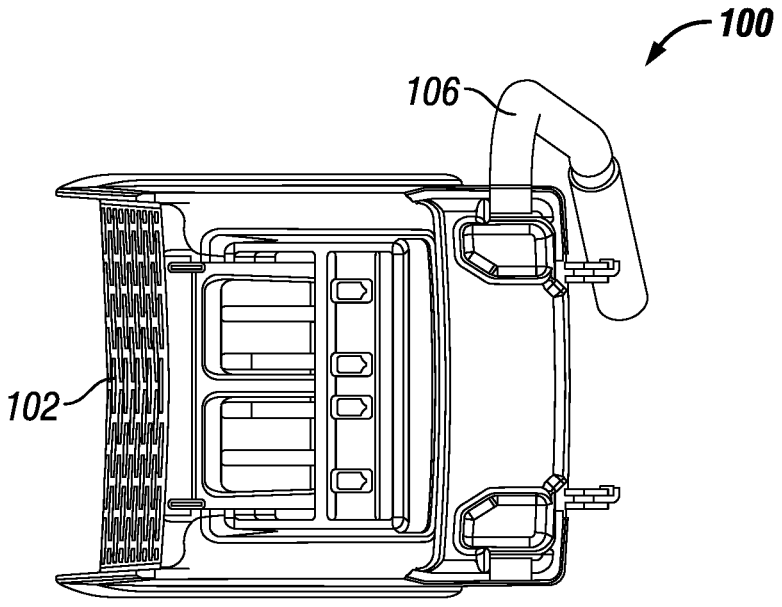
FIG. 7B is a lower view of the wringer of FIG. 7A.
Figure 7D:
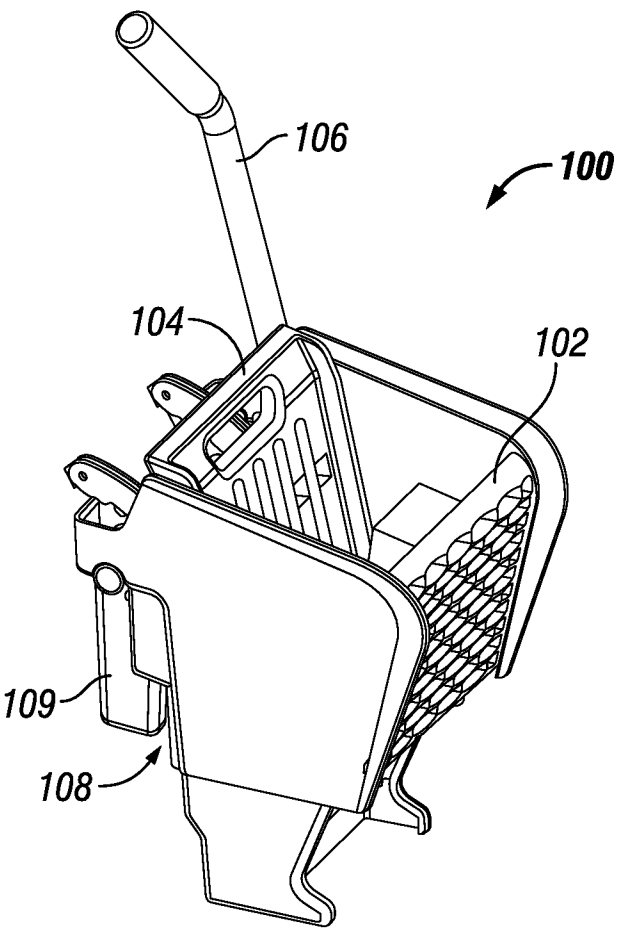
FIG. 7D is an upper perspective view from a second side of the wringer of FIG. 7A.
Figure 7C:
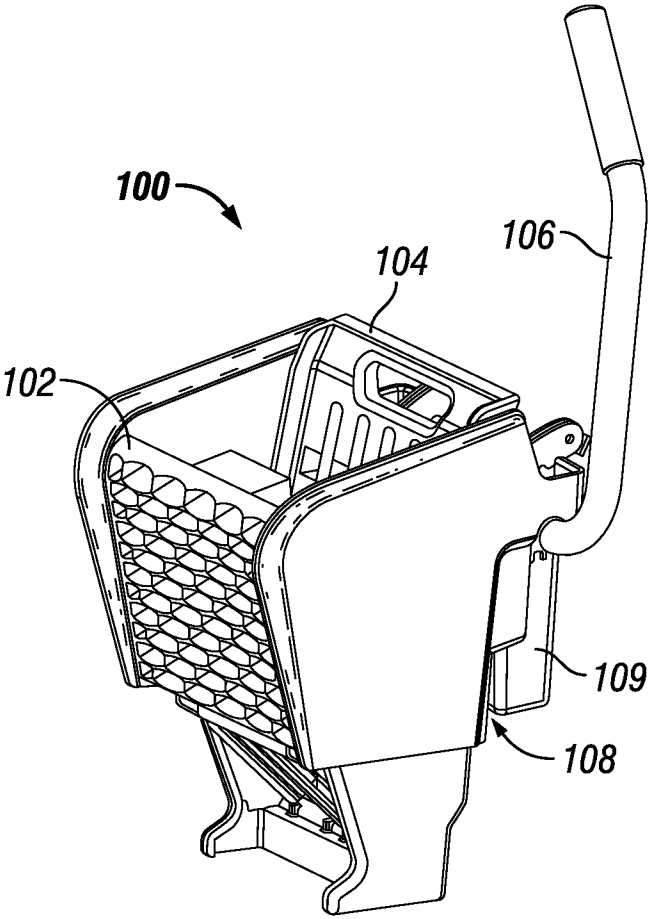
FIG. 7C is an upper perspective view from a first side of the wringer of FIG. 7A.
Figure 7F:
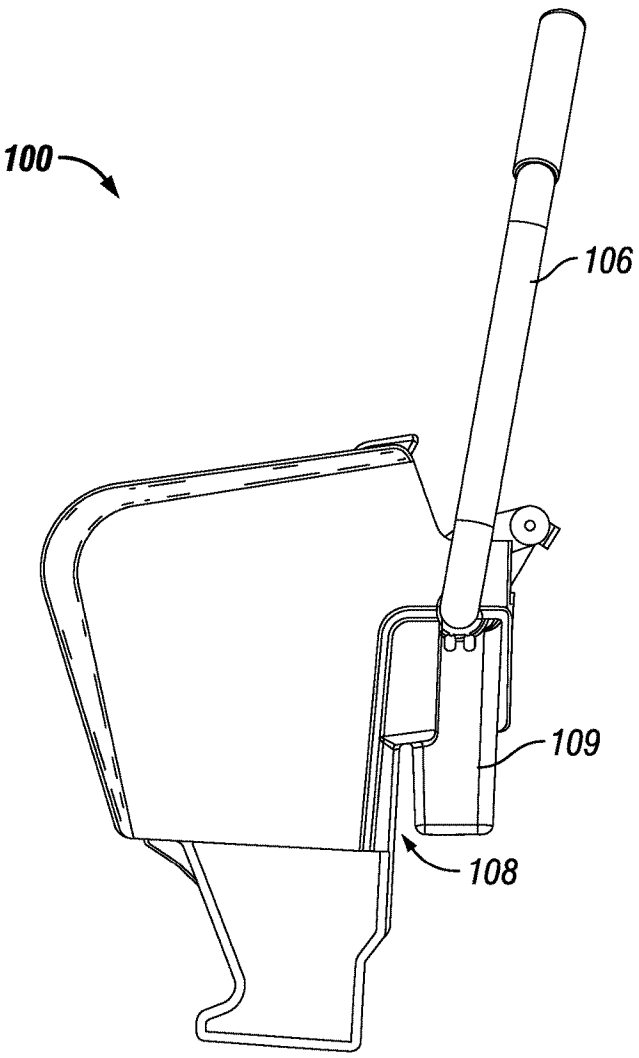
FIG. 7F is a side view of the wringer of FIG. 7A.
Figure 7E:
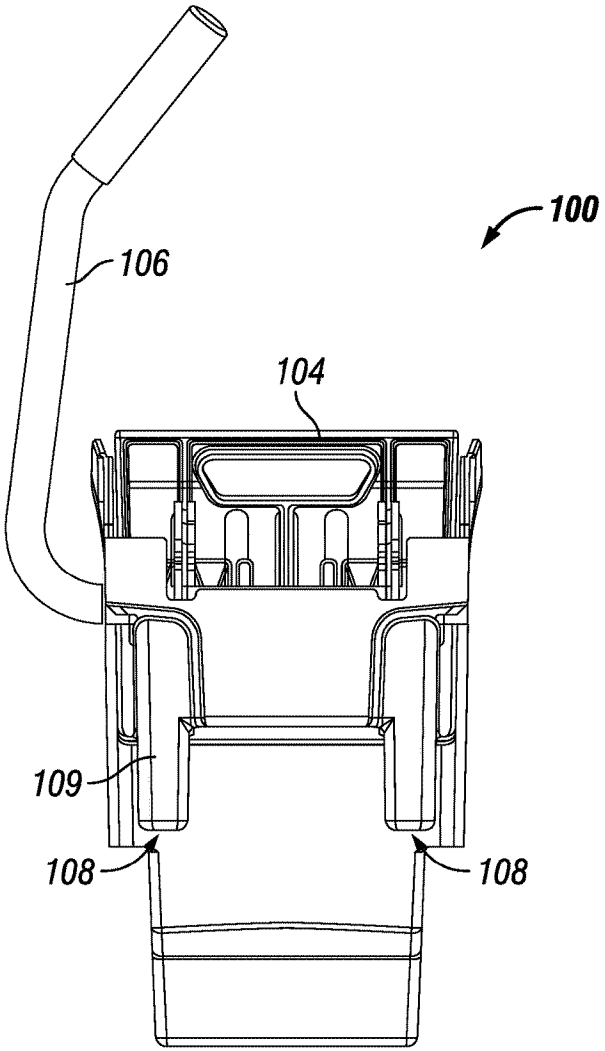
FIG. 7E is a rear view of the wringer of FIG. 7A.
Figure 7H:
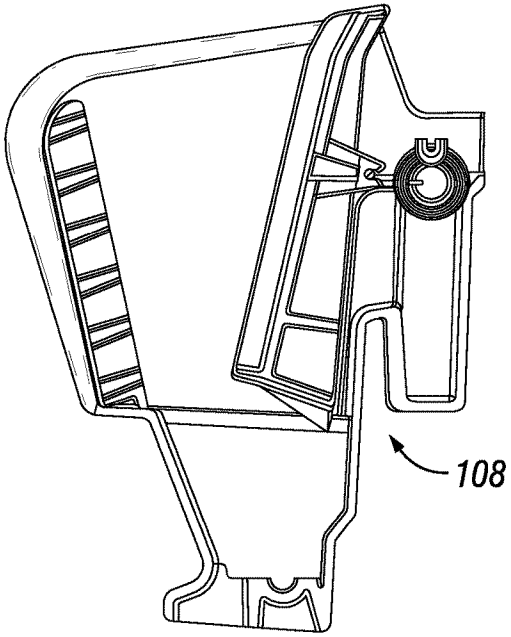
FIG. 7H is a cross-section view of the wringer of FIG. 7A, taken along line 7H of FIG. 7G.
Figure 7G:
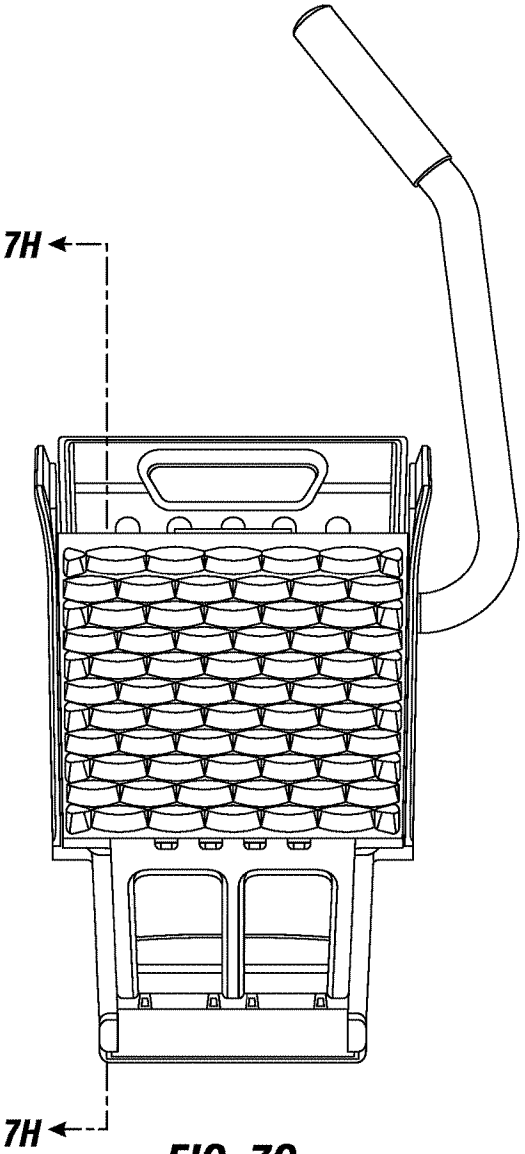
FIG. 7G is a front view of the wringer of FIG. 7A.

As shown in FIG. 6, the energy-dissipation device 50 is disposed within the liquid-retaining portion 20 and extends into the higher-momentum region between the dashed lines 27. The energy-dissipation device 50 may be configured to inhibit buildup of momentum of liquid in the higher-momentum region and inhibit wave-amplification at the liquid surface region along at least a portion of the liquid-movement direction by breaking surface tension of the liquid. In certain embodiments, the energy-dissipation device 50 is disposed within the liquid-retaining portion and extends into the higher-momentum region, such that it is configured to inhibit buildup of momentum of liquid in the higher-momentum region along at least a portion of the liquid-movement direction by breaking surface tension of the liquid. In certain embodiments, the energy-dissipation device extends above the liquid surface when the mop bucket system is in use.

In certain embodiments, the energy-dissipation device 50 includes a first baffle 52 and/or a second baffle 54 disposed between the first and second sidewall portions 22, 23 and within the higher-momentum region. For example, the first and second baffles 52, 54 may be generally planar members that inhibit the flow of liquid. In certain embodiments, the first baffle 52 projects, approximately perpendicular outward, from the third sidewall portion 24 and the second baffle 54 projects, approximately perpendicular outward, from the fourth sidewall portion 25. In some embodiments, the first and second baffles 52, 54 each project a distance W3 (see FIG. 6) of about 2.5 inches from their respective sidewall portions 24, 25. In certain embodiments, the width W3 of a respective baffle 52, 54 is at least approximately 20% of distance W2, could be at least approximately 25%, or could be at least approximately 35%. The length of each baffle is preferably less than its width W3, such that the baffle displaces only a relatively small amount of liquid, while providing the desired functionality. In certain instances, the baffles 52, 54 project from their respective sidewall portions 24, 25, but they could be spaced, i.e., disposed at a distance, from the sidewall portions. In certain embodiments, the first and second baffles 52, 54 are discontinuous in that the first and second baffles do not in combination with each other form a single, uniformly shaped baffle. In certain embodiments, the first and second baffles 52, 54 are located approximately midway between the first and second sidewall portions 22, 23. This positioning may inhibit buildup of momentum of liquid at a location where the relatively high and/or highest liquid velocities can occur.

In certain embodiments, the first baffle 52 projects from the third sidewall portion 24 and the second baffle 54 projects from the fourth sidewall portion 25. In some embodiments, the first and second baffles 52, 54 each project a distance W3 (see FIG. 6) of about 2.5 inches from their respective sidewall portions 24, 25. In certain embodiments, the width W3 of a respective baffle 52, 54 is at least approximately 20% of distance W2, could be at least approximately 25%, or could be at least approximately 35%. The length of each baffle, in certain instances, could be less than its width W3, such that the baffle displaces only a relatively small amount of liquid, while providing the desired functionality. In certain instances, the baffles 52, 54 project from their respective sidewall portions 24, 25, but they could be spaced, i.e., disposed at a distance, from the sidewall portions.

In certain embodiments, as shown in FIG. 6, the energy-dissipation device 50 further includes a third baffle 55 disposed between the third and fourth sidewall portions 24, 25 and within the higher-momentum region, and which projects from the first sidewall portion 22. For example, the third baffle 55 may project from the first sidewall portion 22, and be formed by two opposed sidewalls 57, 59 between which a third sidewall 61 extends. For example, the two opposed sidewalls 57, 59 may be substantially parallel to one another and the third sidewall 61 may be substantially perpendicular to the opposed sidewalls 57, 59. For example, the third sidewall 61 may be positioned within the relatively higher momentum region, such that the third baffle 55 is effective to distribute energy from retained liquid over a surface of the first sidewall portion 22. In some embodiments, as shown in FIG. 6, the third baffle 55 is laterally centered between the third and fourth sidewall portions 24, 25.

In some embodiments, the third baffle 55 projects a distance W4 from the first sidewall portion 22. For example, in some embodiments, the third baffle projects at least about ¼ inch, ½ inch, or 1 inch toward the second sidewall portion 23, relative the first sidewall portion 22. That is, in some embodiments, the opposed sidewalls 57, 59 have a width of at least about ¼ inch, ½ inch, or 1 inch. In some embodiments, the third baffle 55 may have a width W5 of the third sidewall 61 of from about ½ inch to about 4 inches, such as from about 1 inch to about 3 inches, or about 1.5 inches.

As shown in FIG. 5B, the energy-dissipation device 50 can include a plurality of wheel well protrusions 58 disposed at two or four (or another suitable number) of the corners formed at the intersections of the first and third sidewall portions (22, 24), the first and fourth sidewall portions (22, 25), the second and third sidewall portions (23, 24), and/or the second and fourth sidewall portions (23, 25). The wheel well protrusions 58 may be disposed as least partially within the higher-momentum region. In certain embodiments, each of the wheel well protrusions 58 have a generally planar upper surface that is connected to the lower or bottom wall portion 21 via a sidewall, which can be tapered or vertically disposed. For example, the upper surface of the wheel well protrusion 58 may be at a height above the lower or bottom wall portion that is at least about 1%, at least about 2%, or at least about 5% of the height of a shortest of the first, second, third, and fourth sidewall portions. For example, the upper surface of the wheel well protrusion may be at a height of from about 0.5 inch to about 3 inches relative the lower or bottom wall portion.

As shown in FIG. 6, the energy-dissipation device 50 can include projections 56 from the second sidewall portion 23 that are disposed within the higher-momentum region. The projections 56 can be configured to distribute energy from retained liquid over a surface of the second sidewall portion 23. In some embodiments, as shown in FIG. 5B, the projections 56 increase in width W5 in a direction from the first sidewall portion 22 toward the second sidewall portion 23. In certain embodiments, the projections 56 provide a substantially sinusoidal surface along the second sidewall portion 23. In such embodiments, the projections may taper to a largest width W5 of approximately 2 inches, such as 1.94 inches, and project a distance W6 of at least approximately 1 inch, such as 1.12 inches, toward the first sidewall portion 22. The projections may extend to a height above the lower or bottom wall portion that is at least about 25%, at least about 40%, or at least about 50% of the height of a shortest of the first, second, third, and fourth sidewall portions. In some embodiments, the projections 56 can extend along some of or the entire height H2 (see FIG. 5E) of the second sidewall portion 23. The projections 56 from the second sidewall portion 23 allow the energy of the liquid to be effectively distributed over a larger surface area. Thus, as the liquid oscillates in the liquid-retaining portion 20, wave amplification is reduced, which minimizes splashing.

The height of the baffles 52, 54, 55 (and other members that form the energy-dissipation device 50, such as the projections 56) may be configured to extend above the expected liquid-fill height during normal use. Otherwise, if the liquid extends over the baffles 52, 54, 55, they will not break the surface tension of the liquid and their effectiveness may be reduced. Consequently, the first and second baffles 52, 54 may extend to a height H3 (see FIG. 5E) above a corresponding portion of the lower or bottom wall portion that is at least about 25%, at least about 40%, at least about 50%, or at least about 55% of the height of a shortest of the first, second, third, and fourth sidewall portions 22, 23, 24, 25. For example, the height H3 may be about 100% of the height of a shortest of the first, second, third, and fourth sidewall portions 22, 23, 24, 25. For example, the height H3 may be approximately 7 inches, such as 6.70 inches.

The third baffle 55 may extend to a height H4 above a corresponding portion of the lower or bottom wall portion that is at least about 25%, such as at least about 40%, or at least about 50% of the height of a shortest of the first, second, third, and fourth sidewall portions. In one embodiment, the height H4 is approximately 9 inches, such as 8.67 inches.

The baffles 52, 54, 55 can be configured to stop waves before they build up energy or significantly reduce that energy buildup by creating re-circulation zones. The baffles 52, 54, 55 not only break the surface tension of the liquid, they also can act as stop barriers within the flow. As liquid strikes the baffles 52, 54, 55, the ability of the liquid to retain energy is diminished.

The baffles 52, 54 also may force the liquid to travel through a resulting gap between the baffles 52, 54, thereby preventing energy buildup in the liquid. Although there is an increased velocity within the gap between the baffles 52, 54, re-circulation zones on each side of the baffles 52, 54 may allow the energy to dissipate more quickly than without the baffles 52, 54.

In certain embodiments, the elements of the energy-dissipation device 50, i.e., baffles 52, 54, 55, and projections 56, disposed within the liquid-retaining portion 20 are shown as integral with the mop bucket 11. However, those elements of the energy-dissipation device 50 could be formed of structure(s) that are not integrally formed with the mop bucket 11 but instead are connected to the mop bucket 11 or merely placed within the mop bucket 11 without being fixed to it. For example, a baffle could be connected to only the wringer 100 and extend downward from the wringer 100 into the higher-momentum region.

Figure 3:
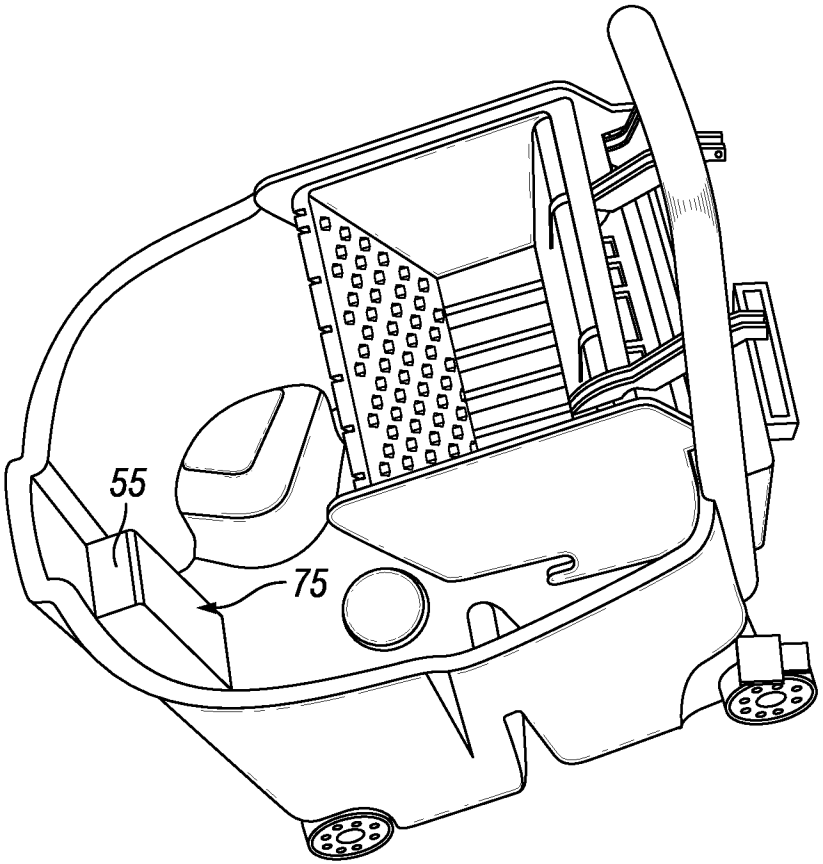
FIG. 3 is an upper perspective view of one embodiments of a mop bucket system.

In certain embodiments, the outer surface 15 of the mop bucket 11, opposite the liquid-retaining portion 20, includes one or more channels corresponding to the baffles 52, 54, 55, and/or projections 56. That is, the channels may be the empty volume defined by the baffles and/or projections. In certain embodiments, the baffles and corresponding channels may be designed to facilitate handling or other functionality of the bucket. For example, as shown in FIG. 1A, the outer surface 15 opposing the first wall portion 22 may include a channel 63 defining the third baffle 55. In some embodiments, the outer surface 15 defines a pocket handle 65 at an end of the channel 63 opposite the lower or bottom wall portion 21. For example, the pocket handle 65 may be formed by opposing sidewalls 67 that project from edges of the channel 63, to form a ledge 69 to facilitate controlled pouring liquid from the liquid-retaining portion 20. For example, the pocket handle 65 may provide a hand-hold for lifting the mop bucket. In some embodiments, as shown in FIG. 3, the channel 63 and/or corresponding third baffle 55 include volumetric graduations 75 to provide an indicator of the volume of liquid contained by the liquid-retaining portion 20. Moreover, as shown in FIG. 1A, the channel 63 may provide a clearance path for a user to step on and actuate pedal 77 to open the drain (not shown) disposed in the lower or bottom wall portion 21.

In certain embodiments, as shown in FIG. 1B, the outer surface 15 at the second sidewall portion 23 defines a handle 71 disposed at or near an end opposite the lower or bottom wall portion 21. For example, the handle may be a suitable loop or bar-type handle or pull handle that allows for lifting and maneuvering of the bucket. In some embodiments, the outer surface 15 at the second sidewall portion 23 defines a pocket handle 73 disposed at or near the lower or bottom wall portion 21. For example, the pocket handle 73 may provide a hand-hold underneath the bucket. Theses handles may be formed integrally with the mop bucket or may be separate components that are coupled, directly or indirectly, to the mop bucket system 10.

In certain embodiments, as shown in FIGS. 1A-1B and 2A-2B, the mop bucket system 10 also includes a wringer 100 for receiving and squeezing the head of a mop, or the like, to remove liquid from the head. Certain embodiments of wringers for mop buckets, as described in the disclosure, are shown in FIGS. 4 and 7A-7G.

As shown in FIGS. 4 and 7A-7G, in some embodiments, a wringer 100 for a mop bucket includes a first wringing plate 102, a second wringing plate 104, which is moveable toward the first wringing plate 102 to wring liquid from a mop, and a wringer arm 106 configured to be actuated to cause movement of the second wringing plate 104 toward the first wringing plate 102, such that the wringer 100 is actuated between a mop-receiving position and a mop-wringing position. Although the second wringing plate 104 is illustrated as being positioned such that it is proximate the handle 106, the positions of the first and second wringing plates could be reversed. One or both of the first and second wringing plates 102, 104 may have one or more drainage openings (e.g., holes, ports, apertures, etc.) disposed in the plates 102, 104 to allow fluid to pass through the plates 102, 104.

The wringer 100 may also include means 108 for attaching the wringer on a rim that defines an opening of a mop bucket. For example, FIGS. 1A-1B illustrate a mop bucket system 10 in which wringer 100 is attached, via means 108, to the rim 13 defining the opening of mop bucket 11. Any suitable attachment means 108 may be used, such as retaining arms 109 or a retaining plate or wall (not shown). For example, as shown in FIG. 2B, the retaining arms 109 may be configured to slidably couple between retaining slots 79 positioned on the outer surface of the second sidewall portion 23.

Figure 2B:
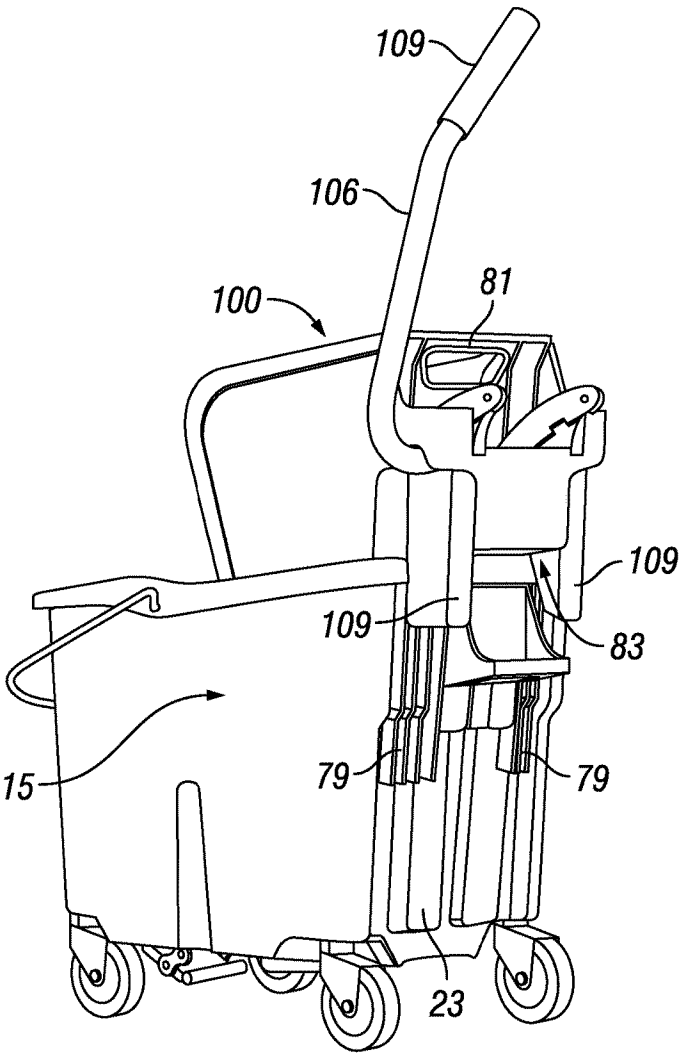
FIG. 2B is a rear perspective view of the mop bucket system of FIG. 2A.

As shown in FIG. 2B, the wringer 100 may include a loop-type handle 81 or other handle opposite the wringer base 130. For example, the handle 81 may allow a user to lift the wringer and/or to separate the wringer from the mop bucket 11. In certain embodiments, the wringer 100 also includes a pocket handle 83 disposed between the base 130 and upper or top portion (e.g., loop handle) of the wringer 100. For example, the pocket handle 83, alone or in combination with the handle 81, may provide a hand hold for a user to controllably and comfortably maneuver and lift the wringer 100.

Figure 2A:
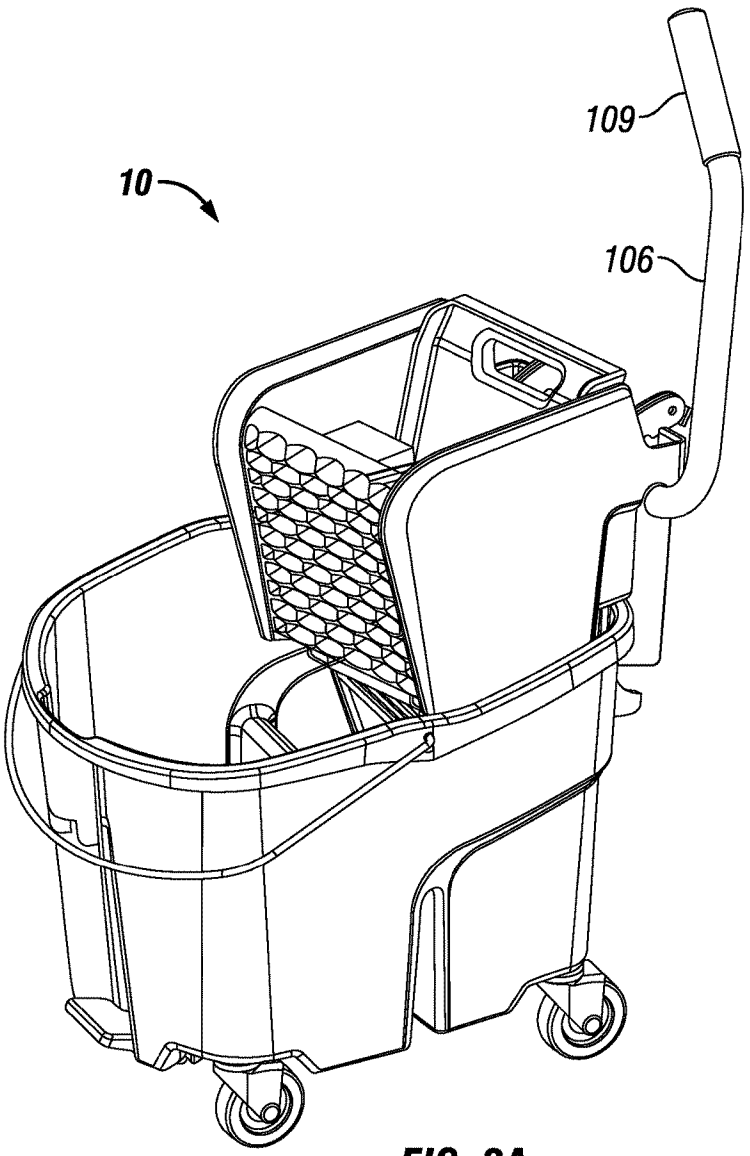
FIG. 2A is a forward perspective view of one embodiment of a mop bucket system.

The wringer arm 106 may have any suitable handle. For example, as shown in FIGS. 1A-1B, the wringer arm 106 may include a loop handle 107 at its distal end. The loop handle 107 may provide additional leverage via which a user can drive and maneuver the mop bucket system 10. In another embodiment, as shown in FIGS. 2A-2B, the wringer arm 106 includes a rod-type handle 109.

Figure 8A:
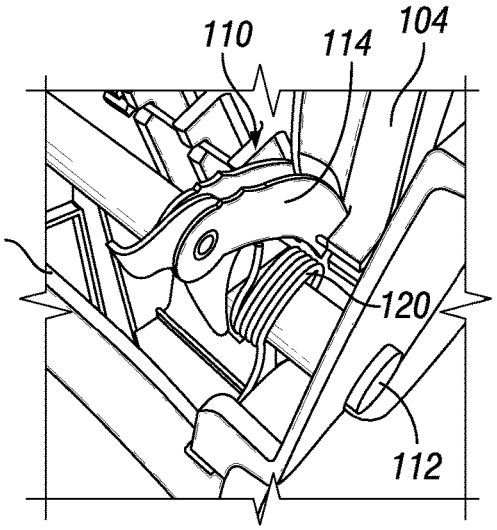
FIG. 8A illustrates a linkage assembly for a wringer and spring.
Figure 8B:
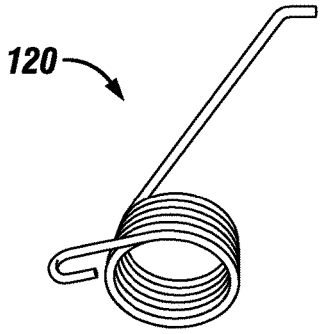
FIG. 8B illustrates one embodiment of a spring for use in the assembly of FIG. 8A.
Figure 9A:
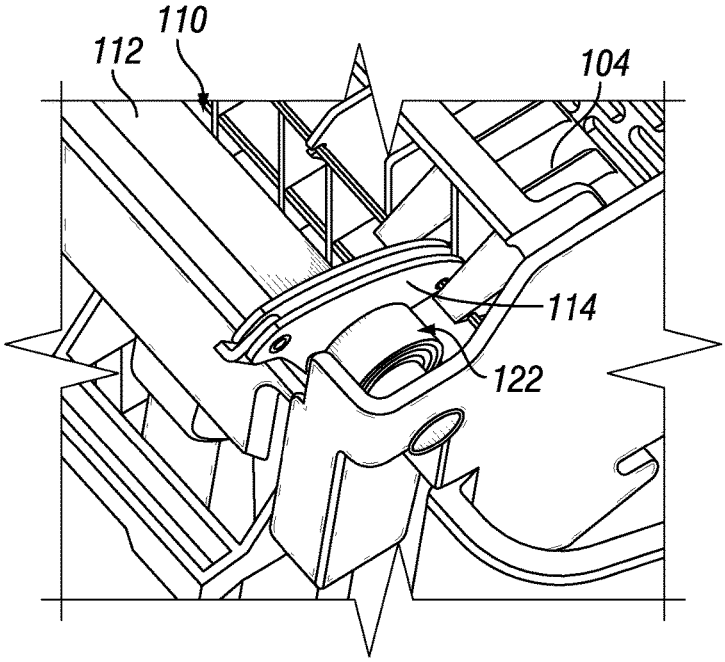
FIG. 9A illustrates a linkage assembly for a wringer and spring.

In certain embodiments, as shown in FIGS. 8-9, a suitable linkage 110 couples the wringer arm 106 to the second wringing plate 104. The linkage 110 may be any suitable or known linkage design, such as those described in U.S. Pat. No. 8,082,620, which is incorporated by reference. For example, as shown in FIGS. 8A and 9A, the linkage 110 may include a shaft 112 having one or more pivotable links 114 coupled to the shaft 112 and to the second wringing plate 104, and a biasing member 120/122 configured to urge the wringer arm 106 and/or the links 114 and the second wringing plate 104 into the mop-receiving position, absent an actuating force being applied. In some embodiments, the biasing member 120/122 is coupled directly to the wringer arm 106. In other embodiments, the biasing member 120/122 is indirectly coupled to the wringer arm 106, such as via linkage 110.

Conventional biasing members can include a helical torsion spring 120, such as shown in FIGS. 8A-8B. However, limitations of the helical torsion spring 120 have been observed, at least in part due to the overstressing of the spring 120 that occurs through vigorous usage, including users maneuvering the mop bucket system 10 by the wringer arm 106. Thus, increasing the capacity of the spring can be achieved; however, conventional linkage mechanisms, such as 110, can offer limited positions and space for the biasing member. For example, it has been determined that a helical torsion spring having a length of over 2 inches may be needed to satisfy return torque levels. Conventional mopping systems do not provide this amount of space for the biasing member, without significant and expensive design modifications being made to the wringer design.

Figure 9B:
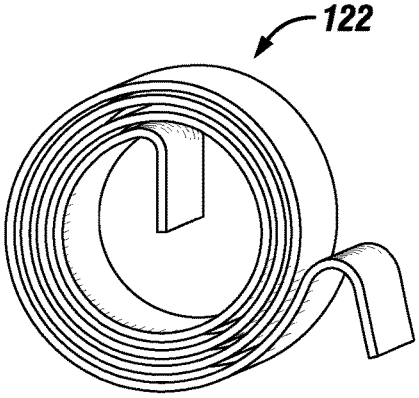
FIG. 9B illustrates one embodiment of a spring for use in the assembly of FIG. 9A.

Thus, in certain embodiments of the wringer 100, as shown in FIGS. 9A-9B, the biasing member is a spiral torsion spring 122 that engages the wringer arm 106 and/or the linkage 110. For example, the spiral torsion spring 122 may be formed from a rectangular strip of spring material (e.g., spring steel such as stainless steel or high carbon steel) that is wound radially outward. The spiral torsion spring 122 has a limited width (e.g., the spiral torsion spring may have a width in an axial direction of less than about 1 inch) and expands and contracts in a radial direction. Depending on the particular wringer 100 design, and the desired torque and spring life, the spiral torsion spring 122 may be selected to have suitable number of coils, strip thickness, arbor diameter (internal), free or case diameter (external), and width. In other embodiments (not shown), the biasing member may be a square wire helical spring, a power spring, a constant force spring, and/or a motor spring.

Figure 4:
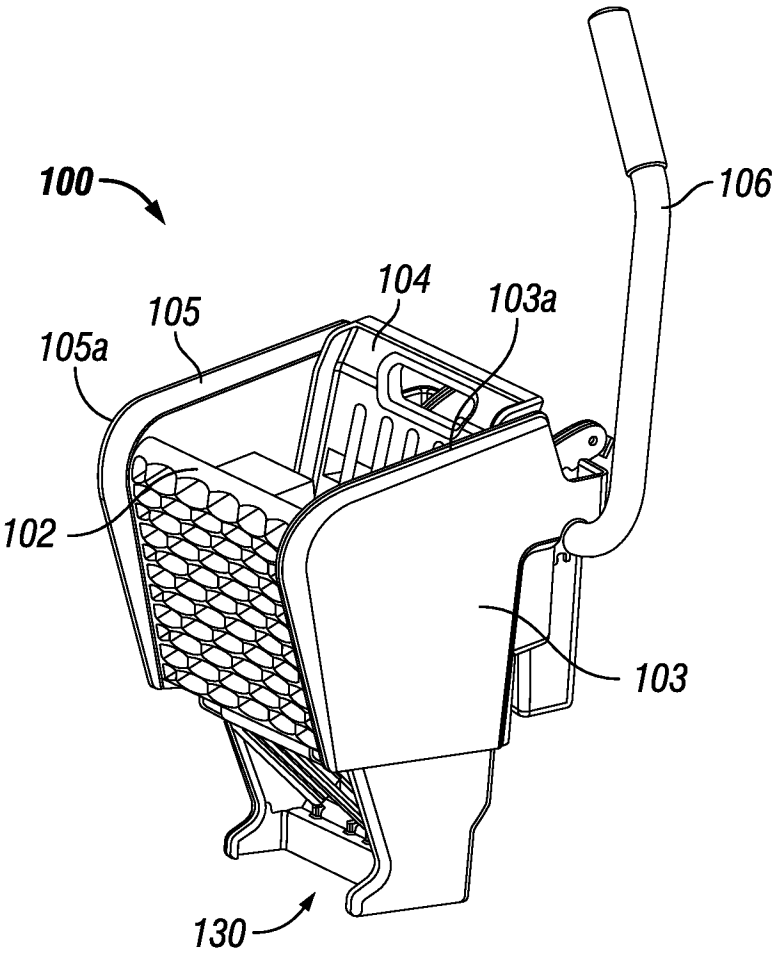
FIG. 4 is a forward perspective view of one embodiment of a wringer.

As shown in FIG. 4, the wringer 100 for a mop bucket includes a first wringing plate 102 and a second wringing plate 104 that extend between first and second wringer sidewalls 103, 105. In certain embodiments, the first wringing plate 102 is configured to be positioned farther from the rim 13 of a mop bucket 11 to which the wringer 100 is attached than the second wringing plate 104 (see, e.g., FIG. 1), and the first and second wringer sidewalls 103, 105 each include a flange 103*a*, 105*a* that extends past the first wringing plate 102 in a direction away from the second wringing plate 104. That is, the flanges 103*a*, 105*a* may be configured as a lip that extends past the fixed first wringing plate 102, to inhibit the splashing of liquid during wringing operations. In certain embodiments, as shown in FIG. 4, the flanges 103*a*, 105*a* are flared away from the first wringing plate 102.

In certain embodiments, as shown in FIG. 4, the wringer 100 further includes a base 130 configured to provide support such that the wringer is standable on a surface, such that the first and second wringing plates 102, 104 are distal to the surface. That is, the base 130 may serve as one or more feet that allow the wringer 100 to stably stand on a surface. In particular, such base 130 may allow the wringer to be operated separate from a mop bucket, such as for fill-empty operations.

The embodiments in this disclosure can be further understood and illustrated by the following non-limiting example.

EXAMPLES

The theoretical performances of a conventional splash reduction bucket (as described and shown at FIGS. 1-5 of U.S. Pat. No. 7,751,831), as shown in FIG. 10, and the mopping bucket in this disclosure having the first and second baffles and a third baffle extending from the first sidewall, as shown in FIG. 11, were compared using computational fluid dynamics (CFD).

The performance of the mop bucket systems was simulated to determine, among other things, the amount of liquid leaving the buckets. The instantaneous and total amounts of liquid leaving the mop bucket systems at any given time permits quantification of the actual performance of mop bucket systems in reducing splashing. To computationally measure this quantity, a simulation was constructed in which a planar field was placed at the floor surface under each mop bucket and, for any quantity of liquid crossing this plane, the volume of liquid was tracked and recorded.

FIG. 12 shows the results of certain simulations, with the total volume of fluid measured as leaving the buckets over time graphically illustrated. It can be seen that the conventional mopping bucket shown in FIG. 10 experienced a total volume of fluid leaving of about 0.001084 $m^3$ over about 40 seconds, whereas the mopping bucket shown in FIG. 11 experienced a total volume of fluid leaving of about 0.000857 $m^3$ over the same period. Thus, the amount of water splashing from the bucket was reduced about 21 percent by the mopping bucket design described in this disclosure.

Next, a cycle of physical bucket movement was developed from the CFD idealized motion. The buckets (both the conventional splash reduction bucket as shown in FIG. 10, and the improved splash reduction bucket having the first and second baffles and a third baffle extending from the first sidewall, as shown in FIG. 11) were moved in accordance with a replicable movement profile, going through the same physical movement profile. Various bucket speed and volume fill levels were tested.

The bucket water volume was measured before the cycles were performed, then the total volume of water was measured after each of the cycles of movement. The percent volume of water lost was then calculated.

In summary, the experimental bucket described in the present application displayed an overall improvement of 28.7% in splash reduction over the conventional splash reducing bucket, averaged over all conditions tested. Further, the experimental bucket matched or outperformed the conventional bucket across all speeds and fill volumes.

In particular, it has been determined that the third baffle extending from the first sidewall of the bucket is diverting the water and minimizing wave energy of the liquid at the front of the bucket to a degree that was not expected over conventional bucket designs. Further, it is believed that while the first and second baffles provide significant splash reduction, the perimeter baffles/projections described herein provide significantly improved dispersion of water surges and splashing.

It will be apparent to those skilled in the art that various modifications and variations can be made to the present disclosure without departing from the spirit and scope of embodiments of the disclosure. Thus, it is intended that the described embodiments cover the modifications and variations of the disclosure provided they come within the scope of the appended claims and their equivalents.

The claimed disclosure is:

1. A mop bucket system, comprising:

a liquid-retaining portion configured to retain liquid and having a lower or bottom wall portion, a first sidewall portion, a second sidewall portion facing the first sidewall portion, a third sidewall portion, and a fourth sidewall portion facing the third sidewall portion, wherein the liquid-retaining portion permits retained liquid to move in a liquid-movement direction extending from the first sidewall portion toward the second sidewall portion within a higher-momentum region; and an energy-dissipation device disposed within the liquid-retaining portion and extending into the higher-momentum region, the energy-dissipation device being configured to inhibit buildup of momentum of liquid in the higher-momentum region along at least a portion of the liquid-movement direction by breaking surface tension of the liquid, wherein the energy-dissipation device comprises:

a first baffle and a second baffle each disposed between the first and second sidewall portions and within the higher-momentum region, wherein the first baffle projects from the third sidewall portion and the second baffle projects from the fourth sidewall portion, and wherein the first and second baffles each project such a distance from the respective third and fourth sidewall portions that the first and second baffles are discontinuous in that the first and second baffles do not in combination form a single, uniformly shaped baffle, and a third baffle disposed between the third and fourth sidewall portions and within the higher-momentum region, wherein the third baffle projects from the first sidewall portion, wherein the third baffle defines opposed first and second baffle sidewalls respectively projecting from the first sidewall portion toward the second sidewall portion to first and second baffle sidewall ends, wherein the opposed first and second baffle sidewalls are substantially parallel to one another, wherein the third baffle defines a third baffle sidewall extending between the first and second baffle sidewalls from the first baffle sidewall end to the second baffle sidewall end, wherein the third baffle sidewall is substantially perpendicular to the opposed first and second sidewalls, wherein the third baffle sidewall is longer than the first and second baffle sidewalls, wherein the third baffle sidewall is connected to the first and second baffle sidewalls by respective curved corners, and wherein the curved corners are configured to deflect flow and promote energy-dissipation in the higher-momentum region.

2. The mop bucket system of claim 1, wherein the third baffle is laterally centered between the third and fourth sidewall portions.

3. The mop bucket system of claim 1, wherein the third baffle extends to a height above the lower or bottom wall portion that is at least 25%, 40%, or 50% of the height of a shortest of the first, second, third, and fourth sidewall portions.

4. The mop bucket system of claim 1, wherein the third baffle projects at least one inch toward the second sidewall portion, relative the first sidewall portion.

5. The mop bucket system of claim 1, wherein:

the mop bucket system comprises an outer surface opposite the liquid-retaining portion, and the outer surface opposing the first sidewall portion comprises a channel defining the third baffle.

6. The mop bucket system of claim 5, wherein outer surface comprises a pocket handle disposed at an end of the channel opposite the lower or bottom wall portion.

7. The mop bucket system of claim 6, wherein the pocket handle is formed by opposing sidewalls that project from edges of the channel, to form a ledge to facilitate pouring liquid from the liquid-retaining portion.

8. The mop bucket system of claim 1, wherein the higher-momentum region has a width that is approximately 70% of a distance between the third sidewall portion and the fourth sidewall portion.

9. The mop bucket system of claim 1, wherein the energy-dissipation device further comprises projections from the second sidewall portion, wherein the projections are disposed within the higher-momentum region.

10. The mop bucket system of claim 9, wherein the projections are configured to distribute energy from retained liquid over a surface of the second sidewall portion.

11. The mop bucket system of claim 9, wherein the projections project at least one inch toward the first sidewall portion, relative the second sidewall portion.

12. The mop bucket system of claim 9, wherein the projections extend to a height above the lower or bottom wall portion that is at least 25%, 40%, 50% of the height of a shortest of the first, second, third, and fourth sidewall portions.

13. The mop bucket system of claim 1, wherein each of the first and second baffles extends to a height above the lower or bottom wall portion that is at least 25%, 40%, or 50% of the height of a shortest of the first, second, third, and fourth sidewall portions.

14. The mop bucket system of claim 1, wherein each of the first and second baffles extends from the sidewall portion to a length that is at least approximately 20%, 25%, or 35% of a distance between the third and fourth sidewall portions.

15. The mop bucket system of claim 1, further comprising rolling members connected to an outer surface opposite the lower or bottom wall portion of the liquid-retaining portion.

16. The mop bucket system of claim 1, wherein:

the mop bucket system comprises an outer surface opposite the liquid-retaining portion, and the outer surface at the second sidewall portion defines a handle disposed at or near an end opposite the lower or bottom wall portion.

17. The mop bucket system of claim 1, wherein:

the mop bucket system comprises an outer surface opposite the liquid-retaining portion, and the outer surface at the second sidewall portion defines a pocket handle disposed at or near the lower or bottom wall portion.

18. The mop bucket system of claim 1, further comprising a wringer.

* * * * *